US007478993B2

(12) United States Patent
Hong et al.

(10) Patent No.: US 7,478,993 B2
(45) Date of Patent: Jan. 20, 2009

(54) COOLING FAN USING COANDA EFFECT TO REDUCE RECIRCULATION

(75) Inventors: Tao Hong, Farmington Hills, MI (US); John R Savage, Rochester Hills, MI (US)

(73) Assignee: Valeo, Inc., Auburn Hills, MI (US)

( * ) Notice: Subject to any disclaimer, the term of this patent is extended or adjusted under 35 U.S.C. 154(b) by 33 days.

(21) Appl. No.: 11/389,736

(22) Filed: Mar. 27, 2006

(65) Prior Publication Data

US 2007/0224044 A1 Sep. 27, 2007

(51) Int. Cl.
*F04D 29/54* (2006.01)

(52) U.S. Cl. ..... 415/211.2; 415/220; 415/221; 415/173.1

(58) Field of Classification Search ..... 415/211.2, 415/220, 221
See application file for complete search history.

(56) References Cited

U.S. PATENT DOCUMENTS

| | | | | |
|---|---|---|---|---|
| 3,144,859 | A | | 8/1964 | Walton |
| 3,433,403 | A | | 3/1969 | Gerlitz |
| 3,858,644 | A | | 1/1975 | Beck et al. |
| 3,872,916 | A | | 3/1975 | Beck |
| 3,937,189 | A | | 2/1976 | Beck |
| 4,061,188 | A | | 12/1977 | Beck |
| 4,173,995 | A | | 11/1979 | Beck |
| 4,180,130 | A | * | 12/1979 | Beck et al. ..... 165/124 |
| 4,184,541 | A | * | 1/1980 | Beck et al. ..... 165/125 |
| 4,357,914 | A | | 11/1982 | Hauser |
| 4,448,573 | A | | 5/1984 | Franz |
| 4,548,548 | A | | 10/1985 | Gray, III |
| 4,607,565 | A | * | 8/1986 | Sugawara et al. ..... 454/319 |
| 4,630,993 | A | | 12/1986 | Jensen |
| 4,871,294 | A | | 10/1989 | Ivanov et al. |
| 5,066,194 | A | | 11/1991 | Amr et al. |
| 5,443,363 | A | | 8/1995 | Cho |
| 5,489,186 | A | | 2/1996 | Yapp et al. |
| 5,577,958 | A | * | 11/1996 | Kumekawa et al. ..... 454/233 |
| 5,762,034 | A | | 6/1998 | Foss |
| 5,881,685 | A | | 3/1999 | Foss et al. |
| 5,971,709 | A | | 10/1999 | Hauser |
| 6,599,088 | B2 | | 7/2003 | Stagg |

FOREIGN PATENT DOCUMENTS

| | | |
|---|---|---|
| DE | 3304297 A1 | 3/1984 |
| FR | 1605211 A | 8/1973 |

* cited by examiner

*Primary Examiner*—Ninh H Nguyen
(74) *Attorney, Agent, or Firm*—Jacox, Meckstroth & Jenkins

(57) ABSTRACT

A cooling fan for an engine in a vehicle. Ordinarily, a fan rotates within a shroud, which surrounds the fan. Leakage can occur between the tips of the fan blades and the shroud, wherein fan exhaust moves forward, and then passes through the fan again. The invention reduces leakage by placing a surface downstream of the fan. The surface employs the Coanda Effect, to urge fan exhaust to continue in the downstream direction, and not move forward as leakage air.

36 Claims, 9 Drawing Sheets

COOLING FAN USING COANDA EFFECT TO REDUCE RECIRCULATION

The invention concerns an approach to reducing air which leaks upstream past fan blades that are moving air downstream.

BACKGROUND OF THE INVENTION

FIG. 1 is a cross-sectional view of a prior-art cooling fan 3, as used in motor vehicles, which cools a radiator (not shown), which extracts heat from engine coolant. A motor 4 rotates a cylindrical hub 5, as indicated by arrow 6, which hub 5 carries fan blades 3. Arrows 7 indicate moving air streams.

One feature of such a fan is that it increases static pressure at point A1, compared with point A2. This pressure differential causes leakage air, indicated by arrows 8 and 8A, to flow in the space between the fan ring 9 and the shroud 12.

This leakage represents a loss in efficiency, since the leaked air was initially pumped or moved to the pressure at point A1, but then drops to the pressure at point A2, but with no work or other useful function being accomplished.

It may appear that the airflow indicated by arrow 8 is penetrating a solid body, namely, the strut 18 which supports stator 21. However, this appearance is an artifact of the cross-sectional representation of FIG. 1. In fact, spaces exist between adjacent stators 21, as indicated schematically by space 24 in FIG. 3. Air can flow as indicated by arrow 27, which corresponds in principle to arrow 8 in FIG. 1.

FIGS. 2A-2D are copies of the like-numbered Figs. in U.S. Pat. No. 5,489,186, and represent strategies proposed by that patent to (1) reduce the leakage and (2) accomplish other beneficial objects.

SUMMARY OF THE INVENTION

In one form of the invention, a duct of increasing cross-sectional area is positioned in the exhaust of a fan, and upstream of stators used to straighten flow. Exhaust of the fan adheres to the walls of the duct because of the Coanda Effect, thereby reducing tendencies of the exhaust to reverse direction and leak upstream, past the tips of the fan blades.

An object of the invention is to provide an improved cooling fan in a motor vehicle.

A further object of the invention is to provide a cooling fan in a motor vehicle which employs the Coanda effect to entrain high pressure air in a flow path to thereby reduce the leakage illustrated in FIG. 1.

In one aspect, one embodiment comprises a cooling system for a vehicle, comprising: a fan which produces exhaust which enters stator vanes downstream; and means, located entirely between the fan and the stator vanes, which increases fan efficiency. In one embodiment, efficiency is increased by at least three percent.

In another aspect, one embodiment comprises a cooling system for a vehicle, comprising: a fan which produces exhaust which includes a leakage flow, which leaks upstream of the fan, past blades of the fan; and means downstream of the fan, which reduces the leakage flow.

In yet another aspect, one embodiment comprises a cooling system for a vehicle, comprising: a fan having an exit diameter D; a Coanda ring surrounding fan exhaust which has an entrance diameter equal to D and which diverts fan exhaust radially outward by a mechanism which includes the Coanda effect; and a stator, entirely downstream of the Coanda ring, past which fan exhaust travels.

In still another aspect, one embodiment comprises a cooling system for a vehicle, comprising: a fan having an exit diameter D; a duct immediately downstream of the fan, having an inlet diameter equal to D; and an exit diameter greater than D, which duct reduces torque required to power the fan.

These and other objects and advantages of the invention will be apparent from the following description, the accompanying drawings and the appended claims.

DETAILED DESCRIPTION OF THE INVENTION

Figure 4:
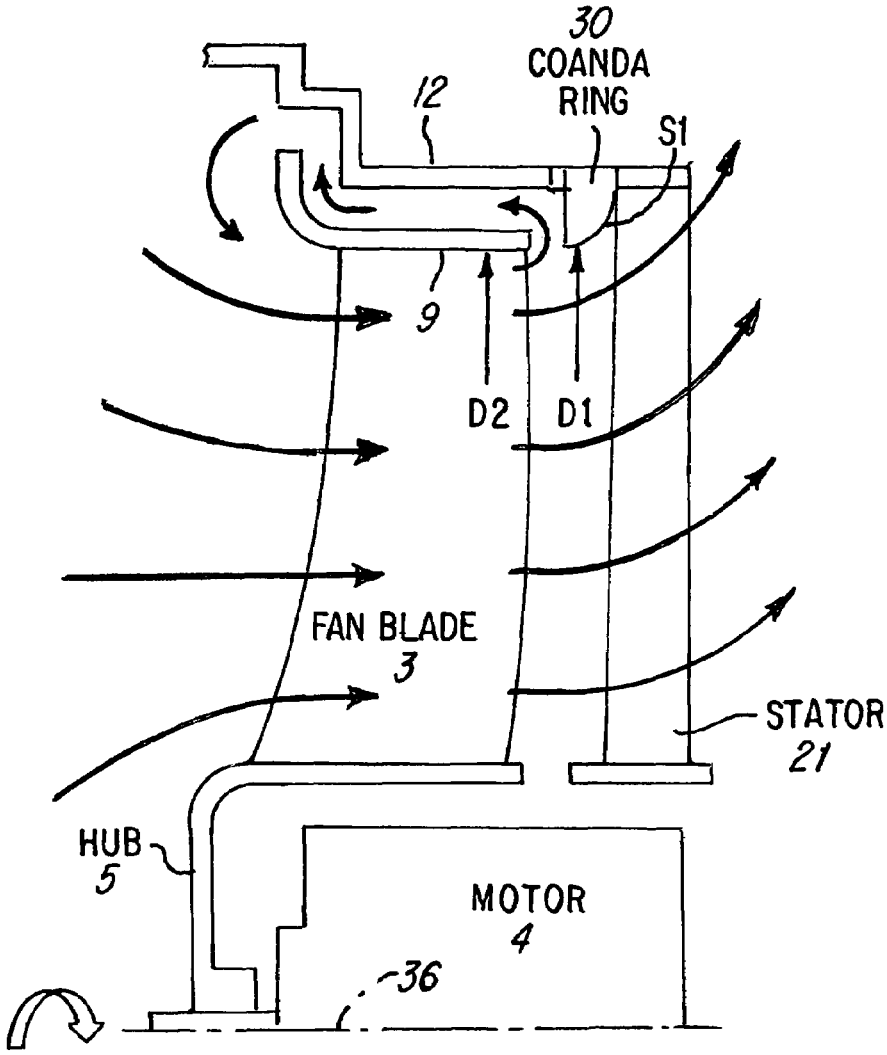
FIG. 4 illustrates one form of the invention.

FIG. 4 is a cross-sectional view of one form of the invention, wherein an annular ring 30, termed a Coanda ring, is stationed downstream of the fan ring 9, and upstream of stator 21. The fan ring 9 is a ring which connects the tips of neighboring fan blades.

Figure 5:
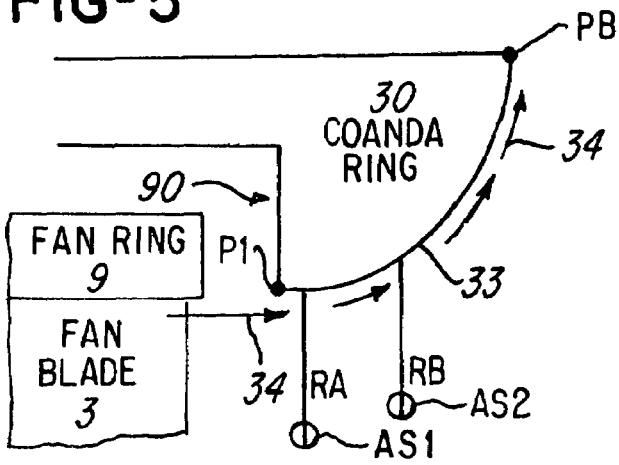
FIG. 5 is an enlarged view of part of FIG. 4.

The inner diameter D1 of the Coanda ring 30 is equal to the inner diameter D2 of the fan ring 9. Further, as shown in FIG. 5, the inner surface 33 of the Coanda ring 30, at the point P1 where fan exhaust enters the Coanda ring 30, is tangent to the fan airflow 34. The inner surface 33 of the Coanda ring 30 then curves away from the central axis 36 in FIG. 4 of the fan, acting somewhat as a diffuser, but while maintaining attached flow along the Coanda ring 30, as discussed later.

Figure 6A:
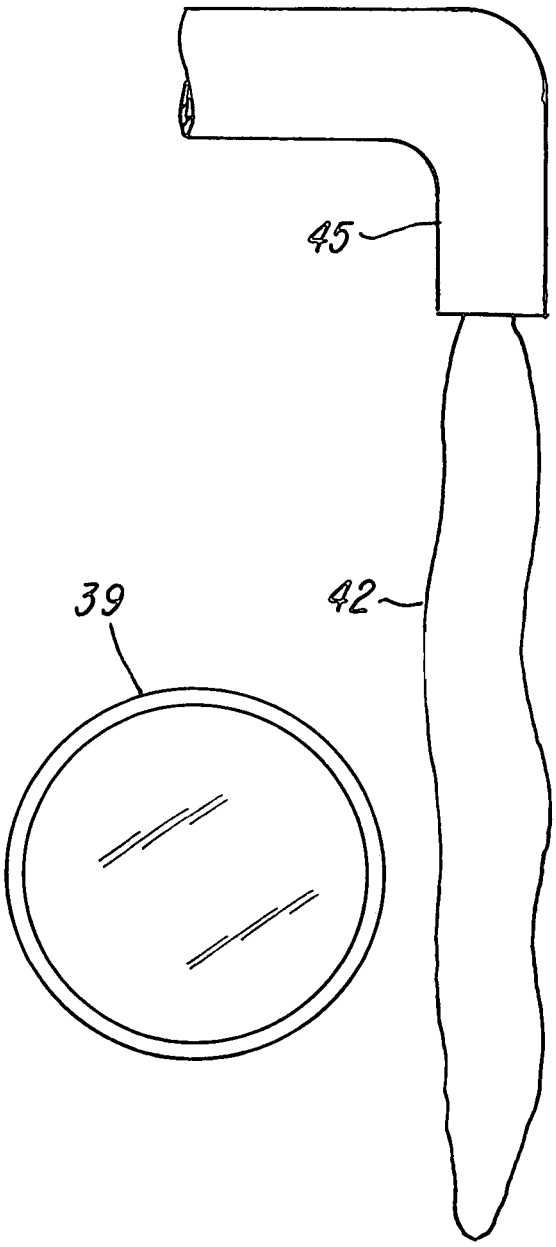
FIGS. 6A and 6B are simplified schematics of a water glass 39 and a water faucet 45, to explain the Coanda Effect.

The Coanda ring 30 utilizes the Coanda effect. The Coanda effect can be easily demonstrated, using an ordinary water faucet and a water glass, held horizontally, both shown in FIGS. 6A and 6B. On the left side of FIG. 6A, the water glass 39 stands outside the water stream 42 emanating from the faucet 45, and the water stream 42 does not contact the glass 39. On the right side of the FIG. 6B, the rightmost wall 48 of the glass 39 touches the water stream 42. Because of the Coanda effect, the water stream 42 adheres to the surface of the glass 39, and follows the contour of the glass 39, until the water stream 42 drops off, at point P2.

The particular location of point P2 will change as conditions of the water stream 42 change. For example, if velocity of the water stream 42 changes, the location of point P2 will, in general, also change.

This example of the Coanda Effect involved a liquid. However, the Coanda Effect also occurs in gases.

FIG. 5 is an enlargement of part of FIG. 4. The Coanda ring 30 entrains airstreams 34 exiting the fan 3 so that the airstreams 34 follow the surface 33 of the Coanda ring 30.

Figure 6B:
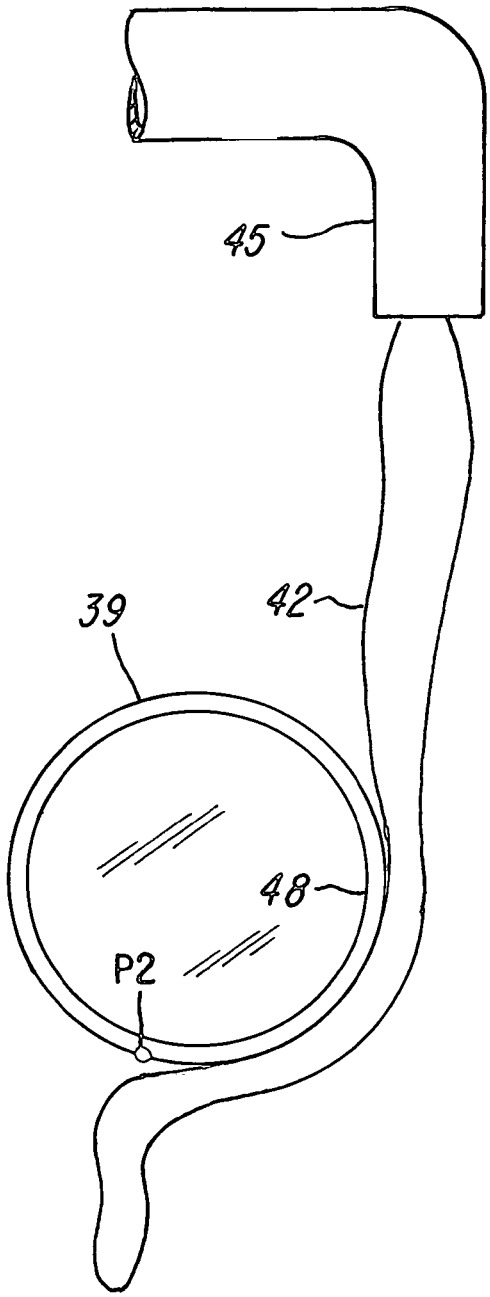

Point P1 in FIG. 5, at the tangent point of the Coanda ring 30, corresponds in principle to the rightmost wall 48 of the water glass 39 in FIG. 6B.

Ideally, the flow along the Coanda ring 30 in FIG. 5 is attached along the entire axial length of the Coanda ring 30, that is, from the tangent point P1 to the exit point PB.

The Coanda ring 30 creates a significant improvement in cooling over that found in the prior art, especially when the exhaust of the fan blades 3 in FIG. 4 is obstructed by an object located downstream, such as an engine block. This will be explained.

Figure 7:
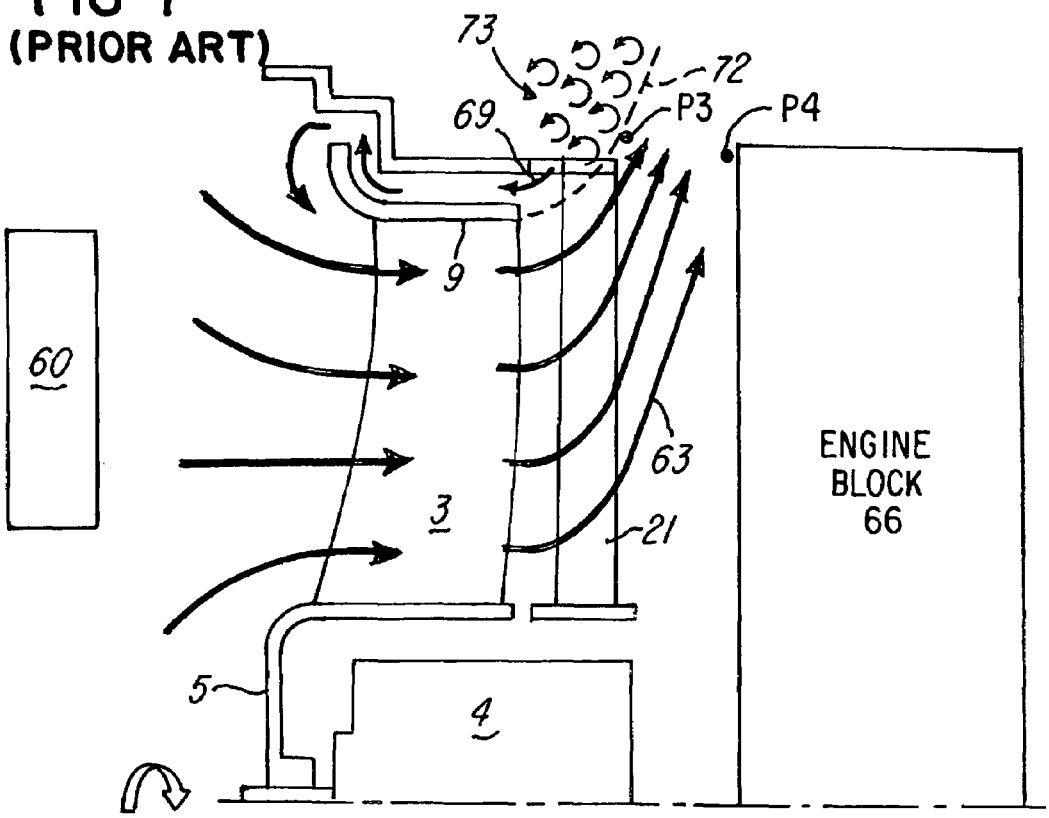
FIG-7 (PRIOR ART)
FIG. 7 illustrates how leakage flow 69 is accompanied by flow reversal and eddies 73, which effectively reduce the cross-sectional area of total exhaust 63 from the fan.

FIG. 7 shows a prior-art cooling fan 3, which may draw air through a radiator, or heat exchanger, 60 and directs exhaust 63 toward an engine block 66, or other major component of the engine. The presence of leakage air 69 requires that a reversal of flow direction of the exhaust 63 occur. Dashed line 72 represents a boundary of the primary stream tube of the fan exit flow. The flow below line 72 is part of the main exit flow of the fan. The flow above line 72 is the region of reversing flow, indicated by loops 73.

The reversing flow is characterized by flow separation from adjacent surfaces and also turbulence and eddies. The average exit velocity of the reversing flow, above line 72, is much less than the velocity within the stream tube of the fan exit flow, below line 72. That is, the air molecules in the reversing flow are traveling in random directions, compared with the air molecules below line 72. Thus, the reversing air molecules above line 72 do not add vectorially to a single vector in a single direction having a relatively large velocity, as they do below line 72. Consequently, the reversing molecules above line 72 can be viewed as stationary or slowly moving compared with the molecules and airflow below the line 72.

From another point of view, the reversing flow (above line 72) has a lower average exit velocity than the rest of the flow (below line 72) exiting the fan 3. As a result, the effective cross-sectional area of total exiting flow is, in effect, limited to that below line 72. The total exiting flow, in effect, is limited to that between points point P3 and P4 in FIG. 7.

Figure 8:
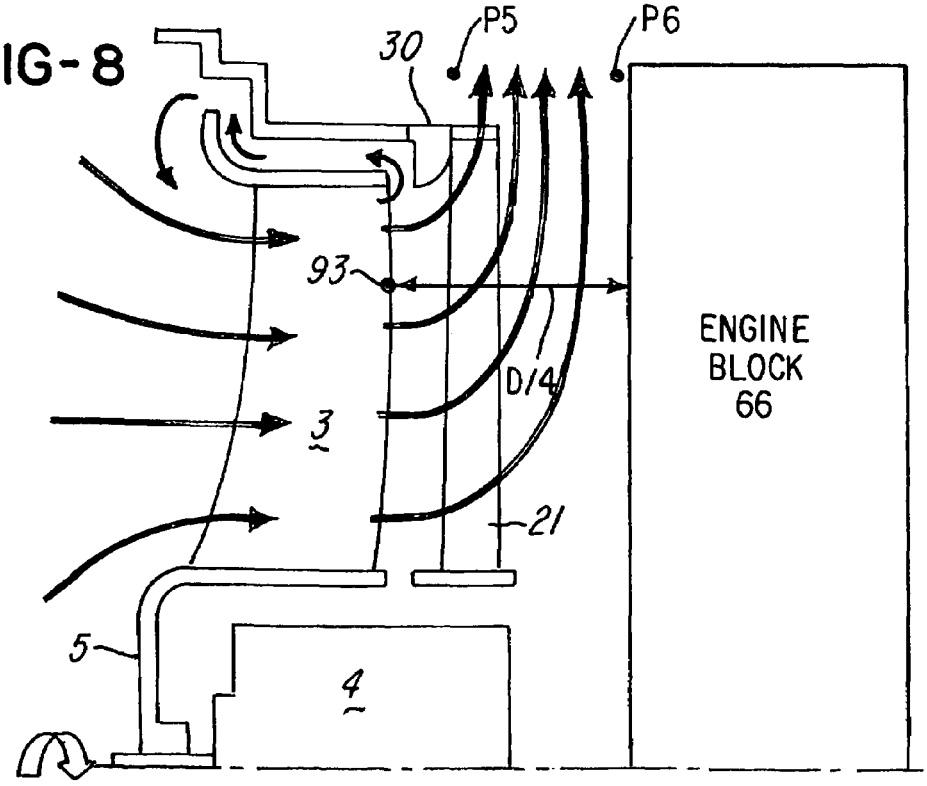
FIG. 8 illustrates how the invention reduces or eliminates the flow reversal and eddies 73, thereby increasing the cross-sectional area of total exhaust from the fan.

In contrast, under the invention as shown in FIG. 8, the Coanda ring 30 reduces the reversing flow. The separated flow above line 72 in FIG. 7 is significantly reduced, or eliminated. Now the cross-sectional area of the flow exiting the fan is increased because of the reduction or elimination of the reversing flow and extends from point P5 to point P6 in FIG. 8.

The Coanda ring 30 has increased flow output by reducing or eliminating the reversing flow shown above line 72 in FIG. 7.

Figure 1:
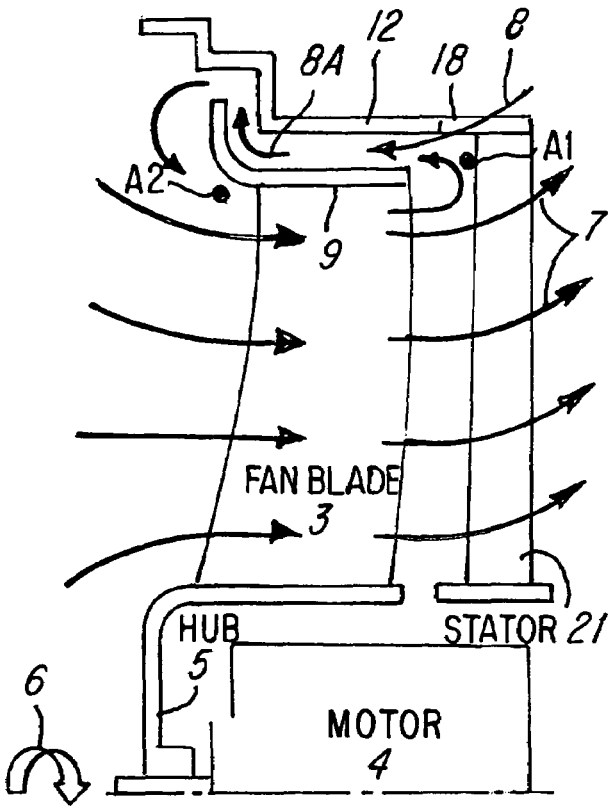
FIG. 1 illustrates leakage in a prior-art fan system.
Figure 9:
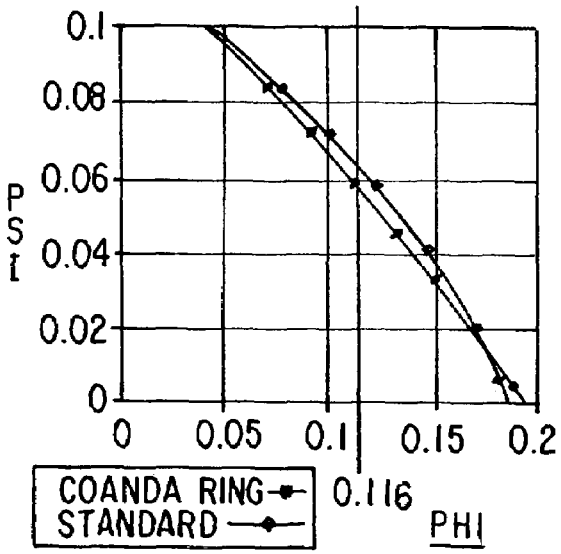
FIGS. 9, 10, and 11 are plots of performance parameters, and compare fan performance with, and without, the Coanda ring 30 of the invention.
Figure 10:
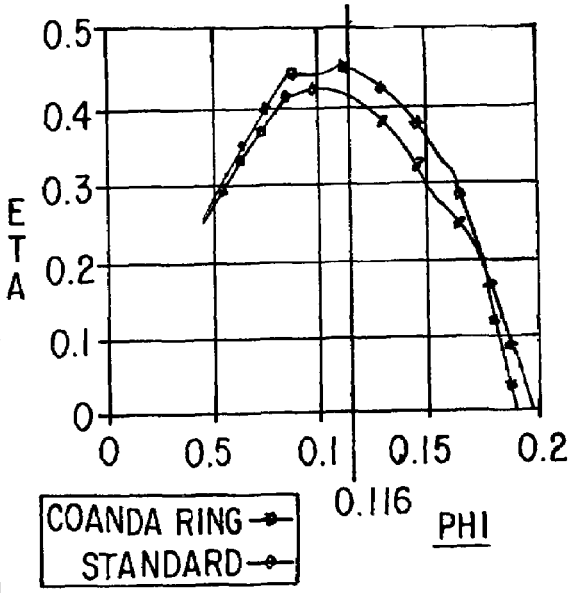
Figure 11:
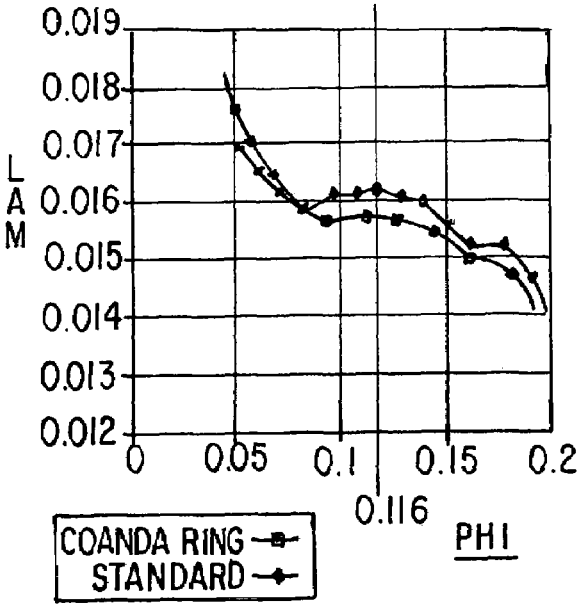

FIGS. 9-11 illustrate experimental results obtained using the Coanda ring 30. In all results, the horizontal axis represents PHI, non-dimensional flow rate through the fan. FIG. 9 illustrates pressure rise, PSI, plotted against PHI. The pressure rise from point A2 to A1 in FIG. 1 represents one such pressure rise.

FIG. 10 illustrates ETA, efficiency, plotted against PHI. FIG. 11 illustrates LAM, non-dimensional torque required to drive the fan, plotted against PHI.

In each plot, a vertical line is drawn at PHI=0.116, which represents vehicle idle condition. This condition is taken as significant because it represents a condition of low fan airflow, yet at a time when high engine cooling can be required, as in bumper-to-bumper traffic on a hot day.

FIG. 9 indicates that, at this idle condition, fan pressure increases in the presence of the Coanda ring 30, which is beneficial. FIG. 11 indicates that torque absorbed by the fan decreases in the presence of the Coanda ring 30, meaning that less power is required by the motor driving the fan 3, which is also beneficial. FIG. 10 indicates an increase in efficiency at this idle condition of about 4 percent, which is considered highly significant.

Figure 17:
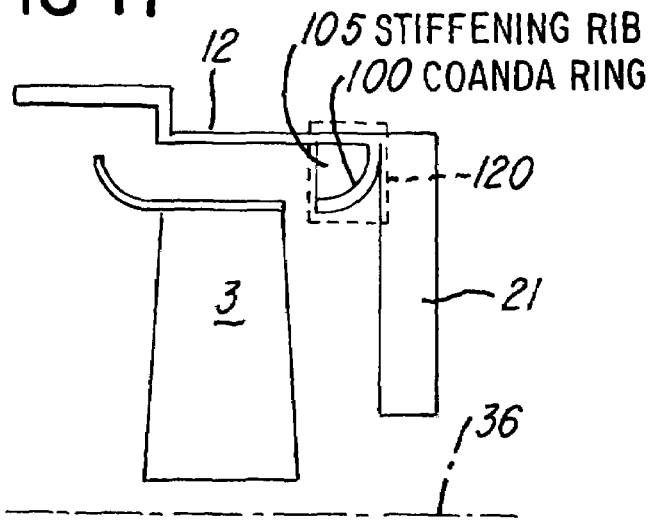
FIG. 17 is a schematic cross-sectional view of one form of the invention.
Figure 18:
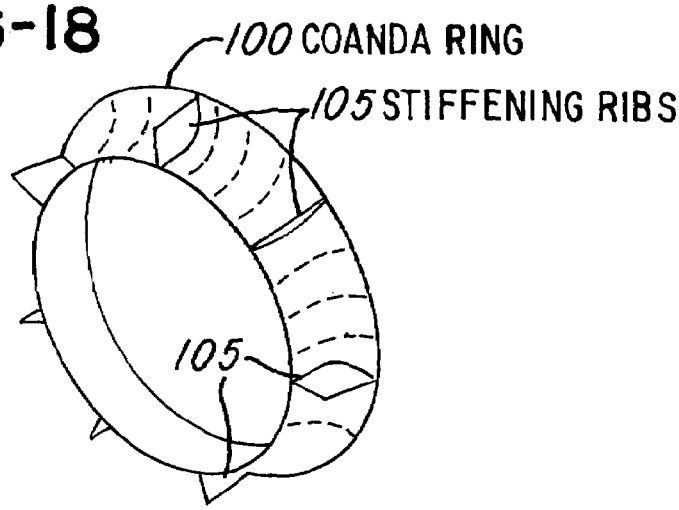
FIG. 18 is a schematic perspective view of Coanda ring 100, with stiffening ribs 105.
Figure 19:
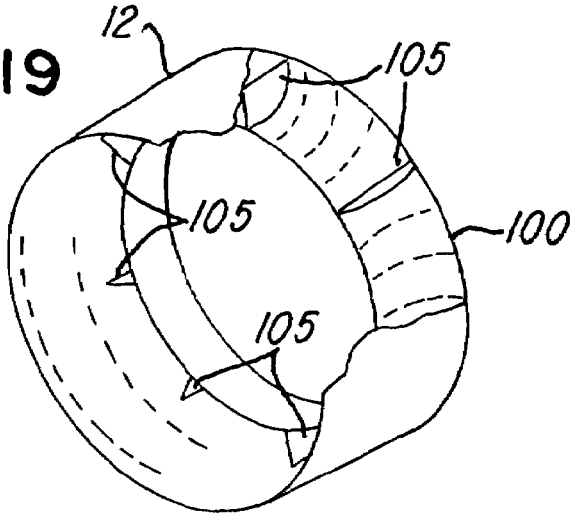
FIG. 19 is a schematic perspective cut-away view, showing the Coanda ring 100 installed within shroud 12.

FIGS. 17-19 illustrate an additional embodiment. Fan blade 3 rotates about axis 36, as in FIG. 4. In FIG. 17, Coanda ring 100 is hollow, as indicated in FIG. 18. Stiffening ribs 105 in FIGS. 17 and 18 connect the Coanda ring 100 with the shroud 12. FIG. 19 is a perspective cut-away view, showing the Coanda ring 100 installed in the shroud 12.

Figure 12:
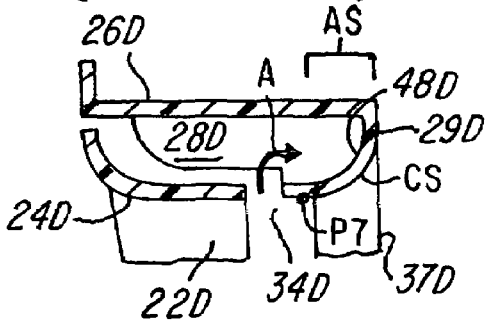
FIG-12 (PRIOR ART)
FIG. 12 is a copy of FIG. 2D, with annotations.

Some significant differences exist between the prior art structure of FIG. 2 and the embodiment of FIGS. 17-19. FIG. 12 shows one prior art structure, with added labels. One difference is that the vane 28D in FIG. 12 is present in the annular gap between the fan ring 24D and the shroud housing 26D. No such vane is present in FIG. 17.

Another difference is that the vane 28D extends into the hollow interior of curved surface 48D. In FIG. 17, no vane which is present in the annular gap between the fan ring 9 and the shroud 12 extends into the hollow interior of the Coanda ring 100. Instead, the stiffening ribs 105 lie completely within the hollow interior of the Coanda ring 100, and do not extend beyond the axial limits of the Coanda ring.

Another difference is that the vanes 28D in FIG. 12 are intended to control direction of recirculation airflow which passes into the annular gap between fan ring 24D and shroud housing 26D. The stiffening ribs 105 in FIG. 17 do not perform this function.

Another difference is that it is clear that the vanes 28D in FIG. 12 are symmetrically distributed about the fan axis (not shown). The stiffening ribs 105 in FIG. 17 need not be symmetrically distributed.

Another difference lies in the fact that, in one form of the invention, the stiffening ribs 105 are adjacent the stators 21 in FIG. 17, and provide mechanical stiffness at the points where the stator 21 is supported by the shroud 12. For example, if a stator is located at the one o'clock position, a stiffening rib 105 is also located at that position. In some designs, the stiffening ribs are used to support the motor 4 of FIG. 1.

Another difference is that the number, K, of stiffening ribs 105 present is sufficiently low that, if the same number, K, of vanes 28D in FIG. 12 were present, that number, K, of vanes 28D would be ineffective to accomplish the optimal re-direction desired by the prior art device. One reason is that, because of the small number, K, of vanes 28D, the space between them is large, so that air flowing midway between a pair of vanes 28D is not subject to diversion by the vanes 28D, because the vanes are too distant.

In one embodiment, the total number of stiffening ribs 105 equals any number from one to ten, and no more. In another embodiment, the stiffening ribs 105 do not form a symmetrical array, or no mirror-image symmetry is present.

ADDITIONAL CONSIDERATIONS

1. Several differences exist between one form of the invention and the prior-art apparatus of FIG. 2D, which is repeated in FIG. 12, with annotations. In FIG. 12, the curved surface 48D is hollow, and no barrier to entry by air into the hollow interior is present. That is, air can enter, as indicated by arrow A. The air can circulate within curved surface 48D after entering.

Further, a turning vane 28D is present, and this vane 28D extends into the hollow interior of curved surface 48D.

Further still, much of the curved surface CS lies at the same axial station AS as does the stator vane 37D.

In contrast to these three features, the Coanda ring 30 of FIG. 5 contains a forward barrier 90, which blocks entry of air to any hollow interior. That is, no airstream A as in FIG. 12 can enter the interior of the Coanda ring 30 in FIG. 54. In one form of the invention, the Coanda ring 30 can be formed of a solid material, or of an expanded foam-like material, either of which prevent entry of air into the interior of the Coanda ring 30.

Figure 2B:
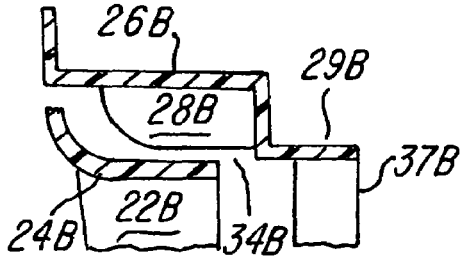
FIG-2B (PRIOR ART)
FIGS. 2A, 2B, 2C, and 2D are copies of like-numbered Figs. in U.S. Pat. No. 5,489,186.
Figure 2C:
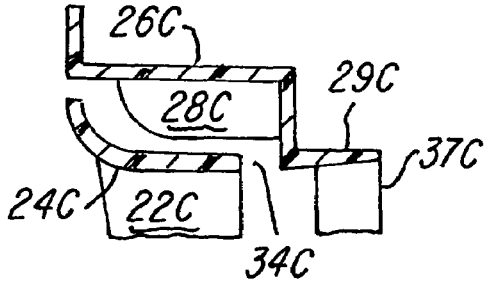
FIG-2C (PRIOR ART)
Figure 2A:
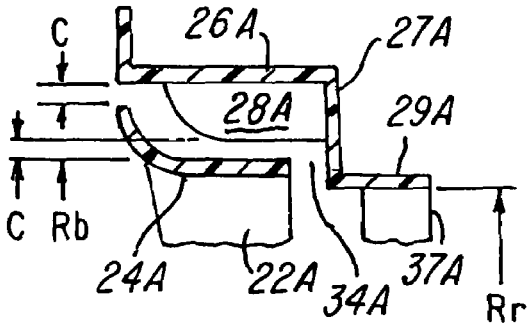
FIG-2A (PRIOR ART)
Figure 2D:
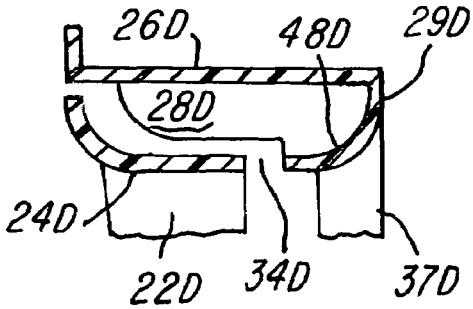
FIG-2D (PRIOR ART)

Also, there is no vane present within any hollow interior of the Coanda ring, unlike the vane 28D of FIGS. 2D and 12.

In addition, the Coanda ring 30 of FIG. 8 lies entirely forward of the stator 21, unlike the situation of FIG. 12.

2. Another difference between the invention and the prior-art apparatus of FIGS. 2D and 12 is that it is unknown whether the prior-art apparatus utilizes the Coanda Effect to maintain attached flow along the outside of curved surface 48D in FIG. 12. That is, it is not known whether flow separation occurs, for example, at point P7 in FIG. 12. Such separation could occur at very high airflows, and the fan could be designed to produce such high airflows. The Coanda Effect would not be present at such separation.

3. Yet another difference between the invention and the prior art apparatus of FIGS. 2D and 12 is that under the invention, a swirl component of the fan exhaust will travel along the Coanda ring 30. In the prior-art apparatus of FIGS. 2D and 12, the stator 37D blocks the swirl. FIGS. 13-15B illustrate the situation.

Figure 13:
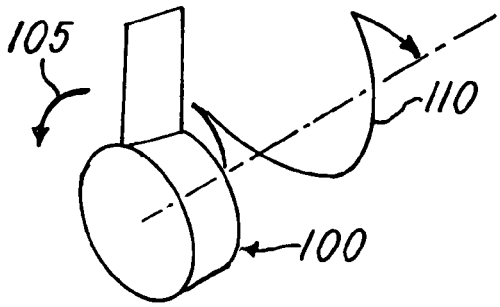
FIG. 13 illustrates how exhaust of a fan follows a helical, or corkscrew, path.

FIG. 13 illustrates a simple, single-bladed fan 100, which rotates in the direction of arrow 105. The exhaust of the fan 100 follows a helical or corkscrew path 110. The circular, or tangential, component of this helical flow is commonly called swirl.

Figure 14A:
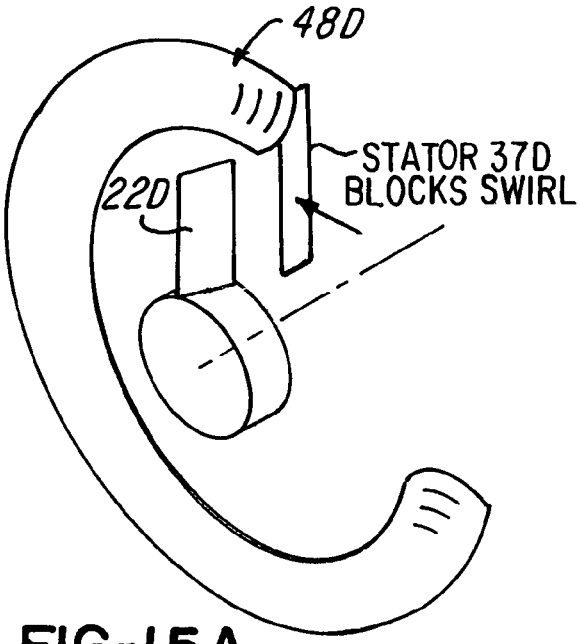
FIGS. 14A and 14B illustrate how the prior-art apparatus of FIG. 2D blocks swirl.
Figure 14B:
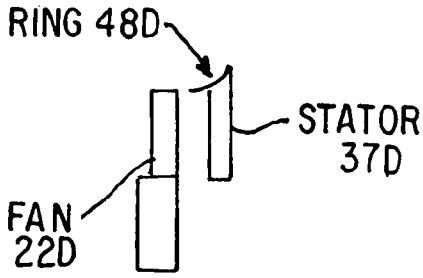

In FIGS. 14A and 14B, which are schematics of the prior-art device of FIGS. 2D and 12, the stator 37D blocks the swirl. More precisely, the swirl surrounded by the ring 48D is blocked when it encounters the stator 37D because the stator 37D is also surrounded by the ring 48D. The bottom of FIG. 14B illustrates the sequential arrangement of the fan 22D, the ring 48D, and the stator 37D. This sequence is also shown in FIG. 2D.

Figure 15A:
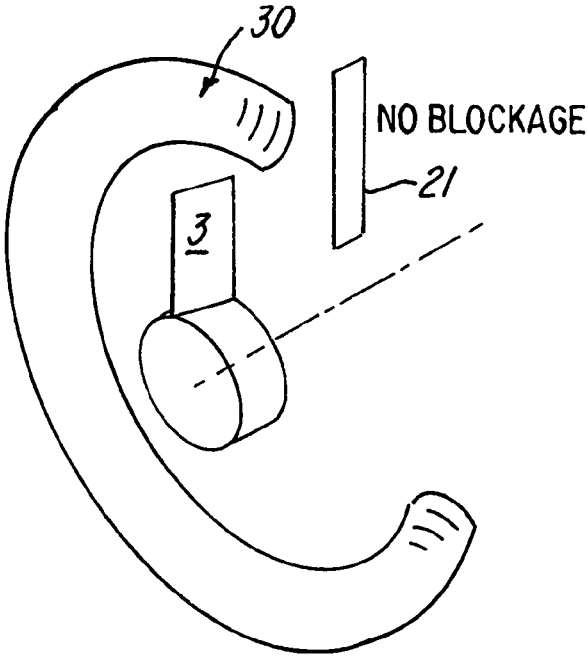
FIGS. 15A and 15B illustrate how the invention does not block swirl as in FIG. 14.

In contrast, as in FIG. 15A, blockage of swirl within the Coanda ring 30 by the stator 21 is not present. One reason is that the stator 21 is not surrounded by the Coanda ring 30. Stator 21 is not present within the Coanda ring 30.

Figure 15B:
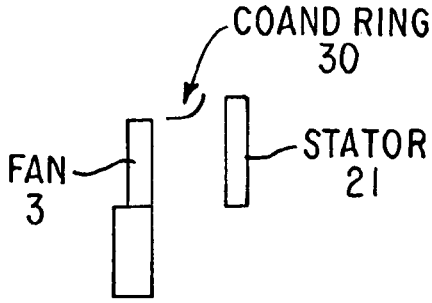

Of course, under the invention, stator 21 in FIG. 15B may modify the swirl. However, stator 21 is entirely downstream of the Coanda ring 30. The swirl still exists unmodified by the stator 21 within the Coanda ring 30.

4. A significant feature of the invention is the increase in effective cross-sectional area of fan exhaust, as indicated in FIG. 8, in the presence of a downstream obstruction. In one example, the obstruction is located less than D14 from the outlet 93 of the fan, wherein D is a fan diameter. In other examples, the obstruction is located D/K downstream of the outlet of the fan, wherein D is a fan diameter and K is a number ranging from, for example, 1 to 10, but the number could range higher.

Figure 16A:
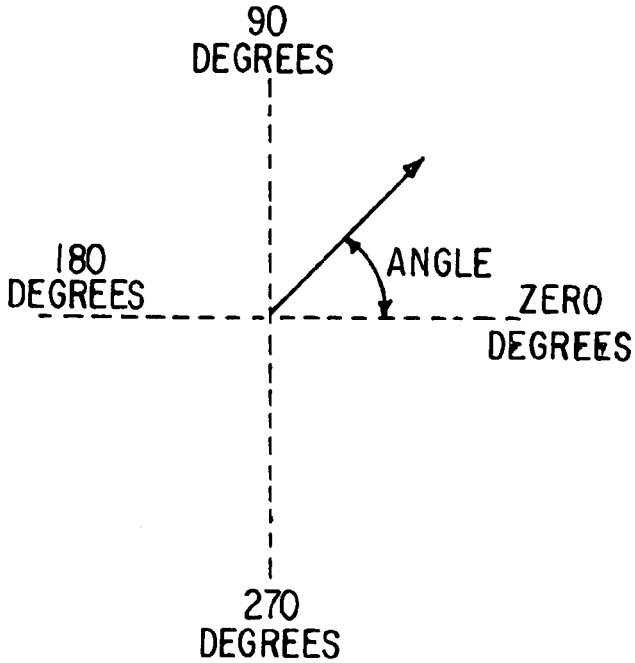
FIGS. 16A, 16B, 16C, 16D and 16E illustrate exit angles of the Coanda ring 30.
Figure 16B:
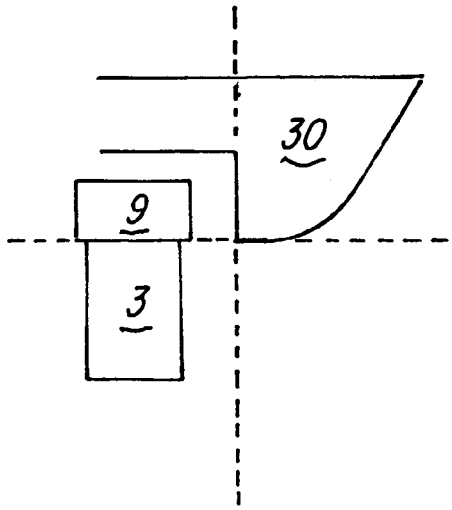
Figure 16C:
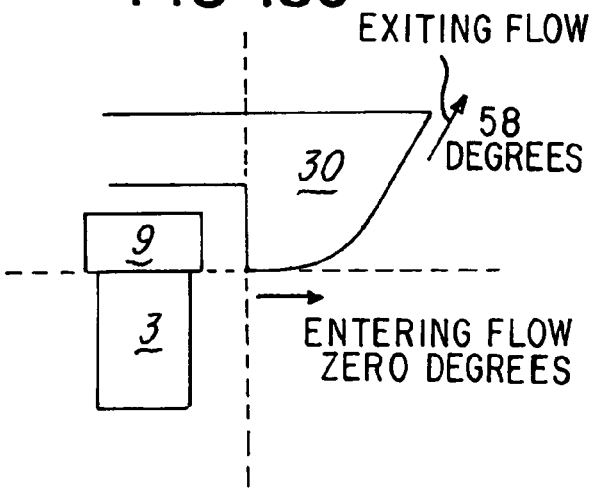

5. The invention maintains attached flow along the Coanda ring 30, as indicated in FIG. 5, during at least one operating mode of the fan, such as the idle operating mode discussed above. In another form of the invention, attached flow is maintained during substantially all modes of operation of the fan. In another form of the invention, attached flow is maintained along the Coanda ring 30, as indicated in FIG. 5, during at least one operating mode of the fan, such as the idle operating mode discussed above. In yet another form of the invention, attached flow is maintained during substantially all modes of operation of the fan 6. FIG. 16A, top left, illustrates a standard cylindrical coordinate system. The coordinate system is superimposed on the Coanda ring 30 of FIG. 5 in the upper right part of FIG. 16B. As the lower right part of FIG. 16C indicates, flow entering the Coanda ring 30 enters at zero degrees, and exits at about 58 degrees.

Figure 16D:
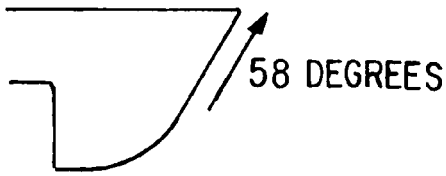
Figure 16E:
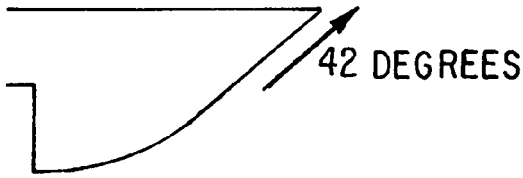

It is expected that the exiting angle will determine the point of separation of fluid from the Coanda ring 30. That is, for example, if no separation occurs for a given flow velocity and the exit angle of 58 degrees shown, separation may occur if the exit angle is changed to 90 degrees. FIGS. 16D and 16E show other illustrative exiting angles.

To determine the limiting exit angle, in one form of the invention, the shape of the Coanda ring 30 is determined experimentally. That is, for example, a desired flow rate of fan exhaust is first established, and then different Coanda rings are tested. All Coanda rings have the same entrance angle, namely, zero degrees, which is tangent to the fan exhaust. But the different Coanda rings have different exit angles, such as the two rings shown in lower left part of the FIG. 16C. Progressively increasing exit angles are tested until an exit angle is found at which flow separation occurs. This testing can be done in a wind tunnel with smoke visualization.

The exit angle causing flow separation is taken as identifying the limiting Coanda ring. One of the Coanda rings having a smaller exit angle is chosen for use in production.

7. One form of the invention includes the apparatus of FIG. 4 or 8, together with a motor vehicle in which the apparatus is installed. The apparatus cools a radiator (not shown) which extracts heat from engine coolant.

8. FIG. 5 shows a Coanda ring 30 having a curved, convex surface. However, part of the surface (not shown) may be flat. Also, a flat surface (not shown), such as one extending directly between points P1 and PB, can be used.

Figure 3:
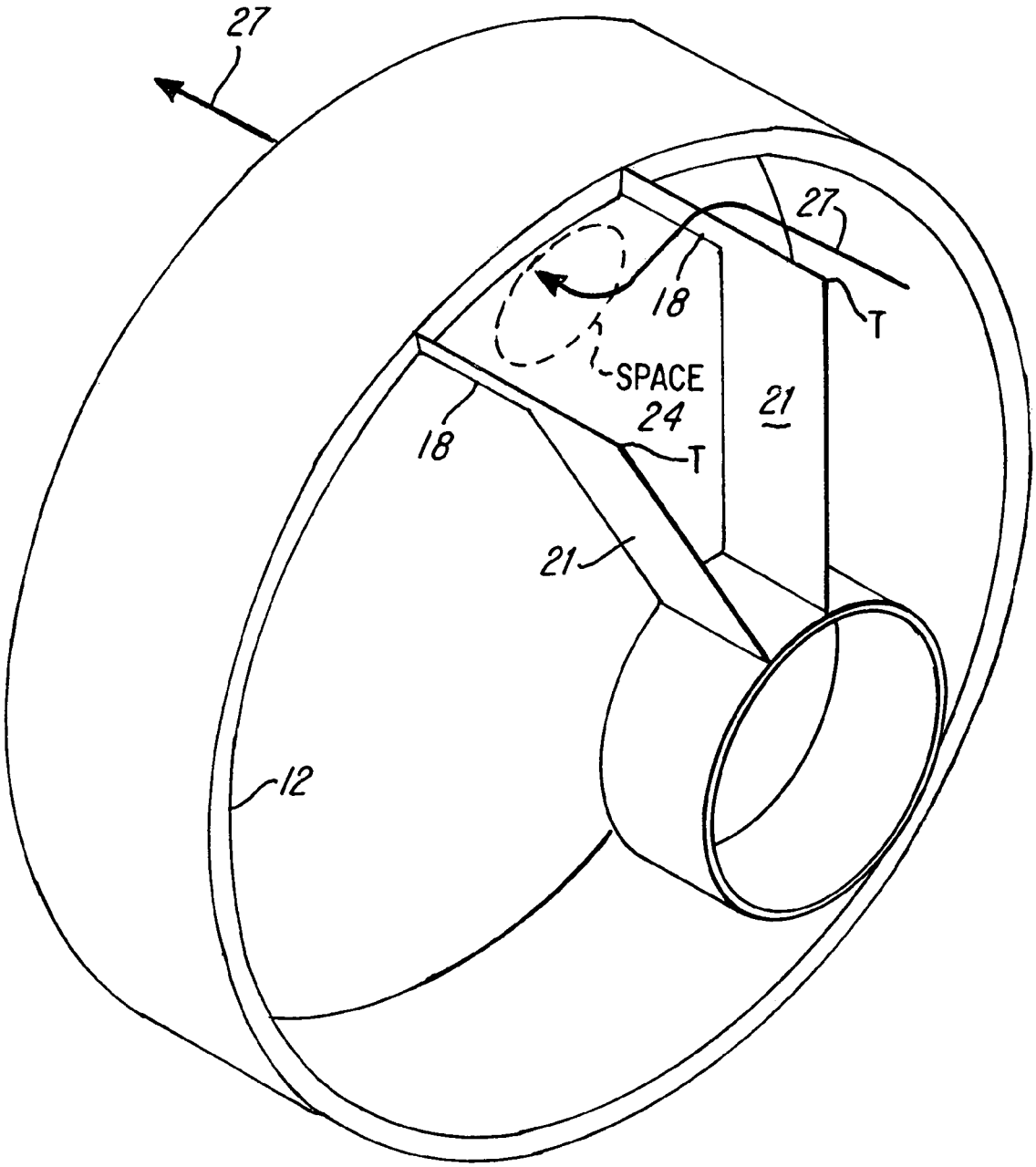
FIG. 3 illustrates a space 24 between struts 18 and explains that struts 18 in FIG. 1 are not present at all circumferential positions along shroud 12, so that flow path 8 in FIG. 1 can actually be present.

9. In FIG. 3, the part of ring 12 spanning between struts 18 blocks radial flow. That is, this part of the ring 12 acts as a barrier to radial flow. In contrast, in one form of the invention, there is no corresponding barrier between tips T of stator blades 21. Radial flow is possible past tips T, between adjacent stator blades 21.

10. In FIG. 4, the Coanda Ring 30 has an inner surface S1, which is a surface of revolution about axis 36. In FIG. 5, the inner surface S1 has an inner radius (or diameter) RA at an axial station AS1, and an inner radius (or diameter) RB at an axial station AS2. Axial station AS2 is closer to the stator vanes 21 than is axial station AS1. Radius RA is smaller than radius RB. From another perspective, the diameter and cross sectional area of the channel bounded by surface S1 both increase as one approaches the stator vanes 21, and both increase in the downstream direction.

11. In FIG. 5, an entrance can be defined at the left side, that is, the upstream side, of the Coanda Ring 30. An exit can be defined at the right side, that is, the downstream side. The exit diameter is larger than the entrance diameter.

12. One form of the invention comprises one or more of the following: the stationary ring 12 in FIG. 4, the Coanda Ring 30, and the stator vanes 21. It is possible that these components will be manufactured by a plastics fabrication supplier, which will not manufacture the motor 4, or the associated fan. The components in FIG. 4, obtained from different suppliers, will then be assembled together.

One form of the invention resides in the unitary molded article, constructed of plastic resin, which includes the structure of FIG. 18, together with all of shroud 12 in FIG. 17. FIG. 19 is a schematic view of this structure.

Another form of the invention is the unitary structure shown in cross section within dashed box 120 in FIG. 17. It includes the structure of FIG. 18, surrounded and attached to part of shroud 12 of FIG. 17, but no other components.

Numerous substitutions and modifications can be undertaken without departing from the true spirit and scope of the invention. What is desired to be secured by Letters Patent is the invention as defined in the following claims.

What is claimed is:

1. A cooling system for a vehicle, comprising:

a) a shroud;

b) a fan in operative relationship with said shroud and having a plurality of fan blades that produce exhaust which enters a plurality of stator vanes axially downstream of said fan, said fan and said plurality of stator vanes being located upstream of an engine in the vehicle; and c) means, located entirely between said fan and said plurality of stator vanes, which increases fan efficiency by directing more airflow downstream of said fan and said plurality of stator vanes and toward or about said engine, wherein said means comprises at least one Coanda ring axially downstream of said fan and upstream of said plurality of stator vanes and wherein said plurality of stator vanes are axially downstream of said fan;

said fan, said shroud and said at least one Coanda ring cooperating to define a passageway wherein said at least one Coanda ring and said fan cooperate to define an inlet to said passageway and said fan and said shroud cooperate to define an outlet to said passageway.

2. The system according to claim 1, wherein said means comprises a device employing Coanda Effect, which reduces leakage between the fan and a shroud surrounding the fan.

3. Apparatus according to claim 1, wherein the means increases fan efficiency by at least 3 percent.

4. A cooling system for a vehicle, comprising:

a) a shroud;

b) a fan in operative relationship with said shroud and having a plurality of fan blades that produce exhaust which includes a leakage flow, which leaks upstream of said fan, past said plurality of fan blades, said fan being located upstream of an engine in the vehicle; and c) means entirely downstream of said fan which reduces the leakage flow, said fan being located upstream of said engine;

wherein said means comprises at least one Coanda ring axially downstream of said fan and upstream of a plurality of stator vanes and wherein said plurality of stator vanes are axially downstream of said fan;

said fan, said shroud and said at least one Coanda ring cooperating to define a passageway wherein said at least one Coanda ring and said fan cooperate to define an inlet to said passageway and said fan and said shroud cooperate to define an outlet to said passageway.

5. The system according to claim 4, wherein said means includes an annular ring surrounding the exhaust, wherein the exhaust is confined by a progressively increasing inner diameter of the annular ring as the exhaust travels downstream.

6. The system according to claim 5, wherein the Coanda Effect causes exhaust to adhere to the annular ring.

7. The system according to claim 6, wherein flow is attached at all points on the annular ring.

8. A cooling system for a vehicle, comprising:

a shroud;

a fan upstream of an engine in the vehicle having an exit diameter D;

a Coanda ring axially downstream of said fan surrounding fan exhaust which has an entrance diameter equal to D, a cross-sectional curvature diverting said fan exhaust radially outward by a mechanism which includes the Coanda Effect; and a stator, entirely downstream of said Coanda ring, past which said fan exhaust travels;

said fan, said shroud and said Coanda ring cooperating to define a passageway wherein said Coanda ring and said fan cooperate to define an inlet to said passageway and said fan and said shroud cooperate to define an outlet to said passageway.

9. The cooling system according to claim 8, wherein said fan exhaust follows the surface of said Coanda ring in attached flow, during under at least one set of operating conditions.

10. The cooling system according to claim 8, wherein said fan exhaust contains swirl, and the swirl passes substantially unimpeded through said Coanda ring.

11. The cooling system according to claim 8, wherein the Coanda ring is hollow.

12. System according to claim 11, and further comprising stiffening ribs internal to the Coanda ring.

13. The cooling system according to claim 8, wherein no vane is present inside the Coanda ring.

14. A cooling system for a vehicle, comprising:

a) a shroud;

b) a fan having an exit diameter D;

c) a duct immediately and generally axially downstream of said fan and upstream of an engine in the vehicle, said duct having an inlet diameter equal to D, and d) an exit diameter greater than D, which duct reduces torque required to power said fan;

said fan, said shroud and said duct cooperating to define a passageway wherein said duct and said fan cooperate to define an inlet to said passageway and said fan and said shroud cooperate to define an outlet to said passageway;

wherein said duct causes exhaust near a surface of the duct to adhere to the surface, and to not reverse direction and leak upstream of the fan.

15. The cooling system according to claim 14, wherein said duct increases pressure rise across the fan.

16. The cooling system according to claim 14, wherein the exhaust adheres to the surface because of the Coanda Effect.

17. The cooling system according to claim 14, wherein said duct has an inlet angle parallel to axis of rotation of the fan, and an outlet angle which points away from said axis.

18. A cooling system apparatus for a vehicle having an engine, comprising:

a) a Coanda ring having a central axis defined therein, and b) a radial array of stator vanes, adjacent, but not within, said Coanda ring, said Coanda ring being situated generally axially between said radial array of stator vanes, a shroud and a fan that is upstream of said engine, said fan directing air toward or around said engine;

said fan, said shroud and said Coanda ring cooperating to define a passageway wherein said Coanda ring and said fan cooperate to define an inlet to said passageway and said fan and said shroud cooperate to define an outlet to said passageway.

19. The cooling system according to claim 18, wherein the Coanda ring has an interior Coanda Surface (S1), which Coanda Surface (S1) comprises:

i) a surface of revolution about the axis; and ii) an inner diameter RA at an axial station AS1; and iii) an inner diameter RB at an axial station AS2, wherein AS2 is closer to the radial array of stator vanes than AS1, and RB is greater than RA.

20. The cooling system according to claim 18, wherein the Coanda ring defines an inner surface (S1) comprising:

i) an entrance and an exit, said exit being adjacent said radial array of stator vanes, and ii) a diameter at said entrance which is smaller than a diameter at said exit.

21. The cooling system according to claim 18, and further comprising:

c) a vehicle having a heat exchanger which is cooled by a fan, wherein the Coanda ring is positioned downstream of the fan, and some exhaust of the fan attaches to the Coanda ring by the Coanda Effect.

22. A cooling system apparatus for a vehicle having an engine and a fan and a shroud surrounding said fan, comprising:

a) a Coanda ring having a central axis defined therein, b) a radial array of stator vanes, adjacent, but not within, said Coanda ring, and c) a vehicle having a heat exchanger which is cooled by said fan, wherein said Coanda ring is positioned axially downstream of said fan, and some exhaust of said fan attaches to said Coanda ring by the Coanda Effect, wherein an engine is located downstream of said Coanda ring, and said Coanda ring diverts some fan exhaust around the engine;

said fan, said shroud and said Coanda ring cooperating to define a passageway wherein said Coanda ring and said fan cooperate to define an inlet to said passageway and said fan and said shroud cooperate to define an outlet to said passageway.

23. A cooling apparatus for a vehicle having an engine and a fan and a shroud surrounding said fan comprising:

a) a cylindrical ring concentric about an axis;

b) a Coanda ring which i) is concentric about said axis;

ii) is adjacent said cylindrical ring;

iii) comprises a surface (S1) of revolution about said axis, which surface (S1) has A) an inner diameter D1 near said cylindrical ring;

B) an inner diameter (R1, R2) which increases as axial distance from said cylindrical ring toward said engine increases; and c) a radial array of stator vanes which is i) concentric about said axis; and ii) adjacent to and generally axial with respect to said Coanda ring;

said fan, said shroud and said Coanda ring cooperating to define a passageway wherein said Coanda ring and said fan cooperate to define an inlet to said passageway and said fan and said shroud cooperate to define an outlet to said passageway.

24. The cooling apparatus according to claim 23, wherein d) the cylindrical ring is effective to cooperate with a fan to form an assembly, wherein the cylindrical ring surrounds fan blades which are connected at their tips by a fan ring;

e) said fan ring has an inner diameter equal to D1; and f) in the assembly, exhaust from the fan blades attaches or follows surface S1.

25. The cooling apparatus according to claim 24, and further comprising:

c) a vehicle having a heat exchanger which is cooled by a fan, wherein the Coanda ring is positioned downstream of the fan, and some exhaust of the fan attaches to the Coanda ring.

26. The cooling apparatus according to claim 25, wherein an engine is located downstream of the Coanda ring, and the Coanda ring diverts some fan exhaust around the engine.

27. A cooling system apparatus for a vehicle having an engine and a fan and a shroud surrounding said fan, comprising:

a) a Coanda ring having a central axis defined therein, and b) a radial array of stator vanes, adjacent to and generally axial with respect to, but not within, said Coanda ring, wherein no stator ring connects tips (T) of said radial array of stator vanes;

said fan, said shroud and said Coanda ring cooperating to define a passageway wherein said Coanda ring and said fan cooperate to define an inlet to said passageway and said fan and said shroud cooperate to define an outlet to said passageway.

28. A cooling system apparatus for a vehicle having an engine, comprising:

a) a Coanda ring having a central axis defined therein, and b) a radial array of stator vanes, adjacent, but not within, said Coanda ring, wherein no barrier is present between outer tips (T) of adjacent said radial array of stator vanes to block radially outward flow between the tips.

29. A cooling apparatus for a vehicle having an engine and a fan and a shroud surrounding said fan comprising:

a) a cylindrical ring concentric about an axis;

b) a Coanda ring which i) is concentric about said axis;

ii) is adjacent said cylindrical ring;

iii) comprises a surface (S1) of revolution about said axis, which surface (S1) has A) an inner diameter D1 near said cylindrical ring;

B) an inner diameter (R1, R2) which increases as axial distance from said cylindrical ring increases; and c) a radial array of stator vanes which is i) concentric about said axis; and ii) adjacent to and generally axial with respect to said Coanda ring wherein no stator ring connects tips (T) of said radial array of stator vanes;

said fan, said shroud and said Coanda ring cooperating to define a passageway wherein said Coanda ring and said fan cooperate to define an inlet to said passageway and said fan and said shroud cooperate to define an outlet to said passageway.

30. A cooling apparatus for a vehicle having an engine and a fan and a shroud surrounding said fan comprising:

a) a cylindrical ring concentric about an axis;

b) a Coanda ring which i) is concentric about said axis;

ii) is adjacent said cylindrical ring;

iii) comprises a surface (S1) of revolution about said axis, which surface (S1) has A) an inner diameter D1 near said cylindrical ring;

B) an inner diameter (R1, R2) which increases as axial distance from said cylindrical ring increases; and c) a radial array of stator vanes which is i) concentric about said axis; and ii) adjacent to and generally axial with respect to said Coanda ring wherein no barrier is present between outer tips (T) of adjacent said radial array of stator vanes to block radially outward flow between the tips;

said fan, said shroud and said Coanda ring cooperating to define a passageway wherein said Coanda ring and said fan cooperate to define an inlet to said passageway and said fan and said shroud cooperate to define an outlet to said passageway.

31. The cooling apparatus for a vehicle having an engine and a fan and a shroud surrounding said fan, comprising:

a) said fan having a central axis and rotatable blades which connect to a fan ring at their tips, the fan ring having an inner diameter D2;

b) a stationary cylindrical ring concentric about the central axis, and surrounding the fan ring;

c) a Coanda ring (30) which i) is generally concentric about the central axis;

ii) is adjacent said stationary cylindrical ring;

iii) comprises an inner surface (S1) which has

A) an entrance, near said fan ring (9), of diameter D1 which equals D2;

B) an inner diameter (R1, R2) which increases as axial distance from said entrance increases; and d) a radial array of stator vanes which is i) generally concentric about the axis (36); and ii) generally axial and downstream of the Coanda ring;

said fan, said shroud and said Coanda ring cooperating to define a passageway wherein said Coanda ring and said fan cooperate to define an inlet to said passageway and said fan and said shroud cooperate to define an outlet to said passageway.

32. The cooling apparatus according to claim 31, wherein some exhaust of the fan attaches to inner surface (S1), and acquires a radial component of velocity.

33. The cooling apparatus according to claim 31, and further comprising:

c) a vehicle having a heat exchanger which is cooled by the fan.

34. The cooling apparatus according to claim 33, wherein an engine is located downstream of said Coanda ring, and said Coanda ring diverts some fan exhaust around said engine.

35. The cooling apparatus, comprising:

a) a fan having a central axis and rotatable blades which connect to a fan ring at their tips, the fan ring having an inner diameter D2;

b) a stationary cylindrical ring concentric about the central axis, and surrounding the fan ring;

c) a Coanda ring (30) which i) is generally concentric about the central axis;

ii) is adjacent said stationary cylindrical ring;

iii) comprises an inner surface (S1) which has

A) an entrance, near said fan ring (9), of diameter D1 which equals D2;

B) an inner diameter (R1, R2) which increases as axial distance from said entrance increases; and d) a radial array of stator vanes which is i) generally concentric about the axis (36); and ii) downstream of the Coanda ring wherein no stator ring connects tips (T) of said radial array of stator vanes.

36. The cooling apparatus, comprising:

a) a fan having a central axis and rotatable blades which connect to a fan ring at their tips, the fan ring having an inner diameter D2;

b) a stationary cylindrical ring concentric about the central axis, and surrounding the fan ring;

c) a Coanda ring (30) which i) is generally concentric about the central axis;

ii) is adjacent said stationary cylindrical ring;

iii) comprises an inner surface (S1) which has

A) an entrance, near said fan ring (9), of diameter D1 which equals D2;

B) an inner diameter (R1, R2) which increases as axial distance from said entrance increases; and d) a radial array of stator vanes which is i) generally concentric about the axis (36); and ii) downstream of the Coanda ring wherein no barrier is present between outer tips (T) of adjacent said radial array of stator vanes to block radially outward flow between said tips;

said fan, a shroud surrounding said fan and said Coanda ring cooperating to define a passageway wherein said Coanda ring and said fan cooperate to define an inlet to said passageway and said fan and said shroud cooperate to define an outlet to said passageway.

* * * * *